US008112981B2

(12) United States Patent
Oda et al.

(10) Patent No.: US 8,112,981 B2
(45) Date of Patent: Feb. 14, 2012

(54) EXTERNAL COMBUSTION ENGINE

(75) Inventors: Shuzo Oda, Kariya (JP); Shinichi Yatsuzuka, Nagoya (JP); Yasunori Niiyama, Kuwana (JP); Takashi Kaneko, Nagoya (JP); Mamoru Shimoda, Toyoake (JP)

(73) Assignee: Denso Corporation, Kariya (JP)

( * ) Notice: Subject to any disclaimer, the term of this patent is extended or adjusted under 35 U.S.C. 154(b) by 443 days.

(21) Appl. No.: 12/321,337

(22) Filed: Jan. 19, 2009

(65) Prior Publication Data

US 2009/0223222 A1 Sep. 10, 2009

(30) Foreign Application Priority Data

Mar. 4, 2008 (JP) ..... 2008-053036

(51) Int. Cl.
*F02C 5/00* (2006.01)

(52) U.S. Cl. ..... 60/39.6; 60/531; 60/515

(58) Field of Classification Search ..... 60/39.6, 60/508–515, 530–531
See application file for complete search history.

(56) References Cited

U.S. PATENT DOCUMENTS 6,931,852 B2 8/2005 Yatsuzuka et al.
6,976,360 B1 * 12/2005 Yatsuzuka et al. ..... 60/645
7,073,331 B2 * 7/2006 Oda et al. ..... 60/508
7,185,491 B2 * 3/2007 Oda et al. ..... 60/508
7,424,802 B2 * 9/2008 Yatsuzuka et al. ..... 60/508
2007/0220888 A1 9/2007 Komaki et al.

FOREIGN PATENT DOCUMENTS

JP 2004-084523 3/2004
JP 2007-255259 10/2007

* cited by examiner

*Primary Examiner* — Hoang Nguyen
(74) *Attorney, Agent, or Firm* — Harness, Dickey & Pierce, PLC

(57) ABSTRACT

An external combustion engine comprising a pipe-shaped main container in which a working fluid is sealed flowably in a liquid state, a heated part formed at a location of one end of the main container and heating part of the working fluid in the main container in order to make it evaporate, a cooled part formed at a location next to the heated part toward the other end of the main container and cooling the vapor of the working fluid evaporated at the heated part in order to make it condense, an output unit communicated with the other end of the main container and converting the displacement of the liquid phase part of the working fluid to mechanical energy for output, and a controller alternately performing a heat storage mode making displacement of the liquid phase part of the working fluid stop in order to make the heated part store heat and an output mode allowing displacement of the liquid phase part of the working fluid and taking output from the output unit.

10 Claims, 6 Drawing Sheets

S110:START-UP MODE
S130:OUTPUT MODE
S140:HEAT STORAGE MODE

EXTERNAL COMBUSTION ENGINE

BACKGROUND OF THE INVENTION

1. Field of the Invention

The present invention relates to an external combustion engine using evaporation and condensation of a working fluid to cause a liquid phase part of a working fluid to displace, and converting the displacement of the liquid phase part of the working fluid to mechanical energy for output.

2. Description of the Related Art

This type of external combustion engine is called a "liquid piston steam engine". In this conventional type of engine, a pipe-shaped container is sealed with a working fluid flowable in a liquid state, a heated part formed at one end of the container is used to heat part of the liquid state working fluid to cause it to evaporate, and a cooled part formed at the middle of the container is used to cool the vapor of the working fluid to cause it to condense. By alternately repeating evaporation and condensation of this working fluid, the liquid phase part of the working fluid is cyclically made to displace (so-called "self-excited vibration"), then this self-excited vibration of the liquid phase part of the working fluid is taken out at an output unit as mechanical energy. (For example, see Japanese Patent Publication (A) No. 2004-84523 and Japanese Patent Publication (A) No. 2007-255259).

In the engine disclosed in Japanese Patent Publication (A) No. 2007-255259, the internal pressure of the container is regulated in accordance with the temperature of the heated part to improve the efficiency of the liquid piston steam engine. Note that in the engine disclosed in Japanese Patent Publication (A) No. 2004-84523, the internal pressure of the container is not regulated.

SUMMARY OF THE INVENTION

According to detailed studies by the inventors, it was learned that in the engine disclosed in the above Japanese Patent Publication (A) No. 2007-255259, the heated part temperature Th and the efficiency $\eta$ of the liquid piston steam engine are in the relationship shown by the graph of FIG. 7. That is, in the above engine, the lower the heated part temperature Th ends up becoming, the lower the efficiency $\eta$ ends up becoming.

Therefore, in the above engine, for example, in the region of the heated part temperature T0 to T1 shown in FIG. 7 (high efficiency region), it is preferable to raise the heated part temperature Th in order to raise the efficiency $\eta$ and obtain the desired efficiency $\eta$.

For example, in the case of utilizing the waste heat of another heat engine (exhaust gas of internal combustion engine etc.) as the heating source of the heater to heat the working fluid, the amount of heat given to the heated part fluctuates. In this case, if the amount of heat given to the heated part is small, there is a possibility that the heated part temperature Th ends up becoming lower and efficiency $\eta$ ends up becoming lower.

Even in a liquid piston steam engine such as disclosed in the above Japanese Patent Publication (A) No. 2004-84523 where the internal pressure of the container is not regulated, in the same way as the engine disclosed in the above Japanese Patent Publication (A) No. 2007-255259, there is a possibility that if the amount of heat given to the heated part is small, the efficiency $\eta$ ends up falling. That is, this is because when the amount of heat given to the heated part is small, the heating efficiency of the working fluid (evaporation efficiency) ends up deteriorating and a drop in the efficiency $\eta$ is invited.

The present invention, in view of the above point, has the improvement of the efficiency as its object, when the amount of heat given to the heater is small.

To achieve the above object, in the aspect of the invention as set forth in claim 1, there are provided:

an external combustion engine comprising:

a pipe-shaped main container in which a working fluid is sealed flowably in a liquid state, a heated part formed at a location of one end of the main container, and heating a part of the working fluid in the main container in order to make it evaporate, a cooled part formed at a location next to the heated part toward the other end of the main container, and cooling the vapor of the working fluid evaporated at the heated part in order to make it condense, an output unit communicated with the other end of the main container, and converting the displacement of the liquid phase part of the working fluid to mechanical energy for output, and a controller alternately performing a heat storage mode making displacement of the liquid phase part stop in order to make the heated part store heat and an output mode allowing displacement of the liquid phase part and taking output from the output unit.

According to this, after the heat storage mode is used to store heat in the heated part, the output mode is performed in order to take output from the output unit.

Compared with the case of constantly taking output from the output unit, it is possible to raise the temperature of the heated part.

Even when the amount of heat given to the heater is small, the heat exchange amount between the heated part and the working fluid can be increased. Therefore, it is possible to improve the efficiency when the amount of heat given to the heater is small.

In the aspect of the invention as set forth in claim 2, there is provided the external combustion engine as set forth in claim 1 wherein the controller only performs the output mode when the amount of heat given to the heated part is large.

When the amount of heat given to the heated part is small, the heat storage mode and the output mode are alternately performed.

Due to this, the efficiency when the amount of heat given to the heated part is small can be made to approach the efficiency when the amount of heat given to the heated part is large.

In the aspect of the invention as set forth in claim 3, there is provided the external combustion engine as set forth in claim 1 wherein the controller decides on the switching between the heat storage mode and the output mode based on the temperature of the heated part.

Due to this, it is possible to efficiently switch between the heat storage mode and the output mode.

In the aspect of the invention as set forth in claim 4, there is provided the external combustion engine as set forth in claim 3 wherein the controller performs the heat storage mode when the temperature of the heated part is less than the first predetermined temperature, switches from the heat storage mode to the output mode when the temperature of the heated part becomes a second predetermined temperature or more in the heat storage mode, and switches from the output mode to the heat storage mode when the temperature of the heated part becomes less than the first predetermined temperature in the output mode.

Due to this, it is possible to effectively improve the efficiency.

In the aspect of the invention as set forth in claim 5, there is provided the external combustion engine as set forth in claim 4 wherein the second predetermined temperature is the first predetermined temperature or more.

In the aspect of the invention as set forth in claim 6, there is provided the external combustion engine as set forth in claim 4 wherein the controller performs a start-up mode driving the output unit from the outside to make the displacement of the liquid phase part of the working fluid start when shifting from the heat storage mode to the output mode.

In the aspect of the invention as set forth in claim 7, there is provided the external combustion engine as set forth in claim 6 wherein the controller performs the start-up mode for a predetermined time.

Due to this, it is possible to easily execute the start-up mode.

In the aspect of the invention as set forth in claim 8, there is provided the external combustion engine as set forth in claim 6 wherein the controller determines the end of the start-up mode based on the output from the output unit and the revolution speed of the output unit.

Due to this, it is possible to shorten the execution time of the start-up mode.

In the aspect of the invention as set forth in claim 9, there are provided:

an external combustion engine comprising:

a pipe-shaped main container in which a working fluid is sealed flowably in a liquid state, a heated part formed at a location of one end of the main container, and heating a part of the working fluid in the main container in order to make it evaporate, a cooled part formed at a location next to the heated part toward the other end of the main container, and cooling the vapor of the working fluid evaporated at the heated part to make it condense, an output unit communicated with the other end of the main container and converting the displacement of the liquid phase part of the working fluid to mechanical energy for output, and a displacement speed regulator for reducing the speed of displacement of the liquid phase part, when the amount of heat given to the heated part is small compared with when the amount of heat given to the heated part is large.

According to this, when the amount of heat given to the heated part is small, it is possible to make the temperature of the heated part close to the temperature of the heated part when the amount of heat given to the heated part is large.

For this reason, the efficiency when the amount of heat given to the heater is small can be improved.

In the aspect of the invention as set forth in claim 10, there is provided the external combustion engine as set forth in claim 9 wherein the displacement speed regulator increases the external load of the output unit in order to reduce the speed of displacement of the liquid phase part of the working fluid.

In the aspect of the invention as set forth in claim 11, there is provided the external combustion engine as set forth in claim 1 further comprising an auxiliary container communicated with a part of the main container between the cooled part and output unit, and sealed with a liquid, and a pressure regulator for regulating an internal pressure of the auxiliary container based on the temperature of the heated part.

According to this, it is possible to adjust the internal pressure of the main container in accordance with the temperature of the heated part, so that a higher efficiency can be obtained.

The present invention may be more fully understood from the description of preferred embodiments of the invention, as set forth below, together with the accompanying drawings.

DESCRIPTION OF THE PREFERRED EMBODIMENTS

First Embodiment

Figure 1:
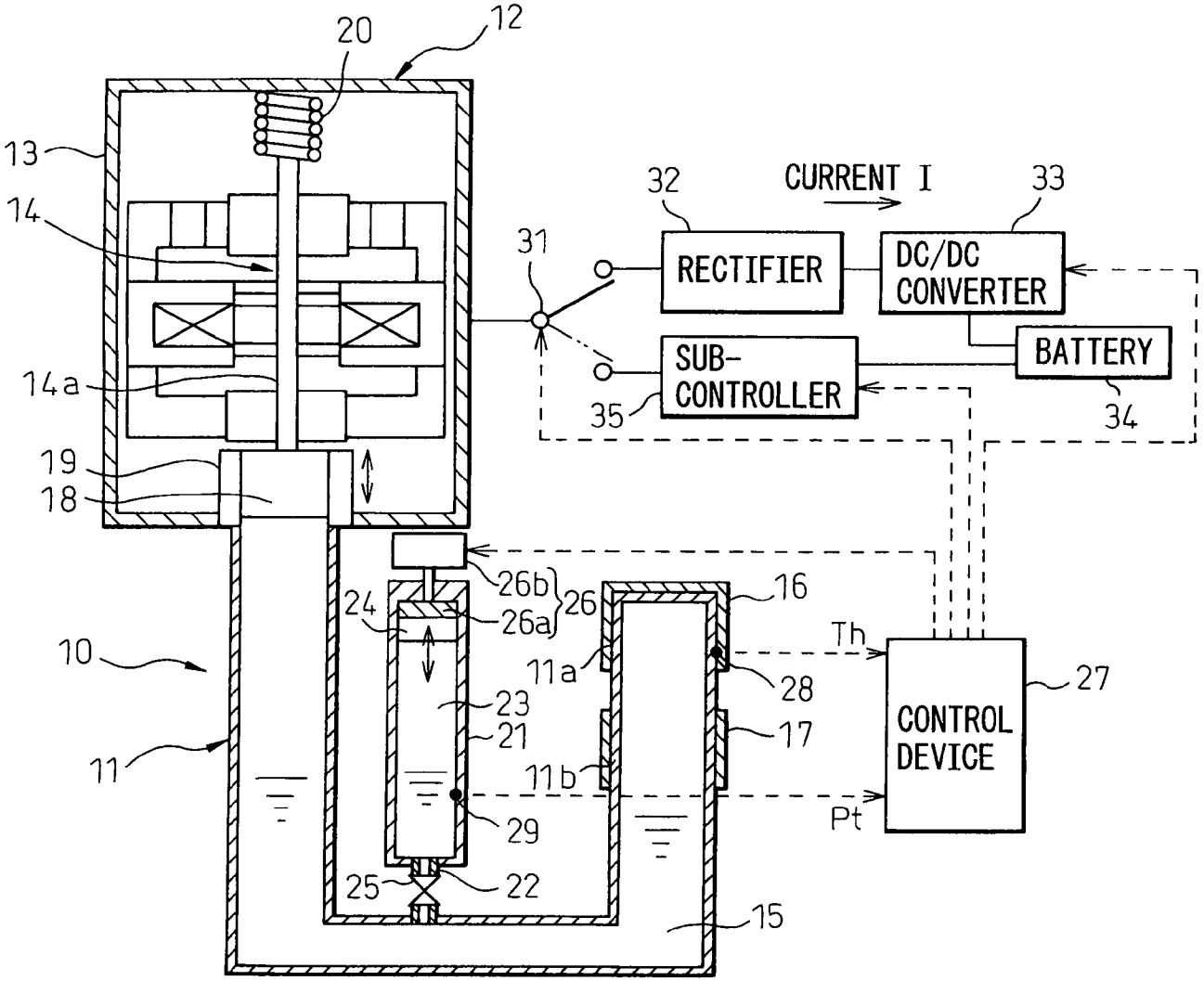
FIG. 1 is a schematic view summarizing the external combustion engine in a first embodiment of the present invention.

Below, a first embodiment of the present invention will be explained based on FIG. 1 to FIG. 3. FIG. 1 is a schematic view summarizing the external combustion engine (liquid piston steam engine) 10 in the present embodiment. The up/down arrow in FIG. 1 shows the up/down direction in the state of installation of the liquid piston steam engine 10.

The liquid piston steam engine 10 has a main container 11 and a generator 12 forming an output unit. Inside a casing of the generator 12, a moving element 14 in which permanent magnets are embedded is housed. If this moving element 14 displaces due to vibration, electromotive force is generated.

The main container 11 is a pipe-shaped pressure container. This has sealed inside it a working fluid (in the present embodiment, steam) 15 flowably in a liquid state. At the outer circumference of the main container 11, a heater 16 for heating part of the liquid state working fluid 15 inside the main container 11 to cause it to evaporate and a cooler 17 for cooling to condense the working fluid 15 heated to evaporate by the heater 16 are arranged in contact.

The main container 11 is formed into an approximately U-shape and is arranged so that its bent part is positioned at its bottom most part and its two ends are positioned at its topmost part. The heater 16 and the cooler 17 are provided at one end side of the main container 11. The heater 16 is arranged so as to be positioned above the cooler 17.

In the present embodiment, the heater 16 exchanges heat with a high temperature gas (for example, automobile exhaust gas) to heat the working fluid 15. The heater 16 may also be constituted by an electric heater. Further, the cooler 17 has cooling water circulated inside it. While not shown, the heat which the cooling water robs from the steam of the working fluid 15 is designed to be radiated to the outside (into the atmosphere) in a radiator arranged in a circulating circuit of the cooling water.

The working fluid 15 is water, so the main container 11 is formed by stainless steel. In the main container 11, the part contacting the heater 16 and making the working fluid 15 evaporate, that is, a heated part 11*a*, and the part contacting cooler 17 and making the working fluid 15 condense, that is, a cooled part 11*b*, may also be formed from copper, aluminum, etc. superior in heat conductivity.

To secure the space in which the working fluid 15 evaporates, a predetermined volume of a gas is sealed above the heated part 11*a*. This gas may for example be air or pure steam of the working fluid 15.

At the other end of the main container 11, a piston 18 displacing by pressure received from the working fluid is arranged slidably in a cylinder part 19. The piston 18 is coupled with a shaft 14*a* of the moving element 14 of the generator 12. At the opposite side of the moving element 14 from the piston 18, a coil spring 20 for pushing the moving element 14 to the piston 18 side is provided.

The generator 12 functions as a so-called motor generator. At the time of normal operation of the liquid piston steam engine 10, power is generated due to the displacement of the piston 18. On the other hand, at the time of start-up of the liquid piston steam engine 10, the piston 18 is driven by power supplied from the outside and this piston 18 acts as a starter motor.

The mechanism for regulating the internal pressure of the main container 11 (below, referred to as the "main container internal pressure") will be explained below. The auxiliary container 21 communicates with the main container 11 through a pipe-shaped communicating part 22. In the present embodiment, the auxiliary container 21 is arranged above the bent part of the main container 11.

The auxiliary container 21 has sealed inside it a liquid 23 and gas 24. In the present embodiment, the liquid 23, like the working fluid 13, is made of water. As the gas 24, a gas exhibiting insolubility in the liquid 23 is preferably used. As the gas 24, helium exhibiting insolubility in water is used. It is also possible to seal only the liquid 23 inside the auxiliary container 21.

The auxiliary container 21 and communicating part 22 are preferably made of materials superior in heat insulating property. In the present embodiment, the liquid 23 is made of water, so the auxiliary container 21 and communicating part 22 are made of stainless steel. The communicating part 22 has a throttling mechanism 25 arranged in it. In the present embodiment, a fixed throttle is used as the throttling mechanism 25. As the throttling mechanism 25, a variable throttle may also be used.

The pressure regulator 26 for regulating the internal pressure Pt of the auxiliary container 21 (below, referred to as the "auxiliary container internal pressure") comprises a pressure regulating piston 26*a* and a power actuator 26*b*. The pressure regulating piston 26*a* is arranged slidably in the vertical direction at the top end side of the auxiliary container 21. The power actuator 26*b* is arranged above the auxiliary container 21 and drives the pressure regulating piston 26*a* in the vertical direction.

The electronic control part in the present embodiment will be summarized below. A control device 27 comprises a known microprocessor including a CPU, ROM, RAM, etc. and its peripheral circuits. The control device 27, a later explained DC/DC converter 33, and a later explained sub-controller 35 constitute the controller in the present invention.

The control device 27 receives as input detection signals of a temperature sensor 28 detecting a temperature Th of the heated part 11*a* (below, referred to as the "heated part temperature") and a pressure sensor 29 detecting the auxiliary container internal pressure Pt for controlling the pressure regulator 26. The control device 27 controls the power actuator 26*b* based on the detection signals of the sensors 28 and 29.

The control device 27 controls the relay 31 to switch between a charging circuit for being charged with the power generated at the generator 12 and the drive circuit for driving the generator 12 as a starter motor.

The charging circuit is comprised of a rectifier 32 rectifying the current generated at the generator 12, a DC/DC converter 33 converting the voltage of the current I rectified at the rectifier 32, and a battery 34 for being charged with the power output from the DC/DC converter 33, which are all connected in series.

The drive circuit is comprised of a sub-controller 35 for controlling the drive of the generator 12 and the battery 34 connected in series. The DC/DC converter 33 and sub-controller 35 are controlled by the control device 27.

The basic operation of the above configuration (normal operation) will be explained below. If operating the heater 16 and cooler 17, a first stroke making the liquid phase part of the working fluid 15 displace toward the generator 12 side is performed. In this first stroke, the liquid state working fluid 15 in the heated part 11*a* is heated to evaporate by the heater 16, steam of the high temperature and high pressure working fluid 15 builds up in the heated part 11*a*, and the liquid surface of the working fluid 15 is pushed down inside the heated part 11*a*.

This being so, the liquid part of the working fluid 15 sealed in the main container 11 displaces from the heated part 11*a* side to the generator 12 side and pushes up the piston 18 of the generator 12, whereby the coil spring 20 is elastically compressed.

After a while, when the liquid surface of the pushed down working fluid 15 reaches the cooled part 11*b* and the steam of the working fluid 15 enters the cooled part 11*b*, a second stroke for making the liquid phase part of the working fluid 15 displace toward the heated part 11*a* side is started.

In this second stroke, the steam of the working fluid 15 entering the cooled part 11*b* is cooled to condense by the cooler 17, so the force pushing down the liquid surface of the working fluid 15 is eliminated. This being so, the piston 18 at the generator 12 side descends due to the elastic recovery force of the coil spring 20.

For this reason, the liquid phase part of the working fluid 15 displaces from the generator 12 side to the heated part 11*a* side, the liquid surface of the working fluid 15 rises to the heated part 11*a*, and the liquid state working fluid 15 is again heated to evaporate at the heated part 11*a*.

The first stroke and second stroke are repeatedly performed until making the operations of the heater 16 and cooler 17 stop. During that time, the liquid phase part of the working fluid 15 in the main container 11 cyclically displaces (so-called "self-excited vibration") and makes the moving element 14 of the generator 12 move up and down.

That is, by the alternately repeating evaporation and condensation of the working fluid 15, the liquid phase part of the working fluid 15 vibrates by self-excited vibration as a liquid piston. This self-excited vibration of the liquid piston is taken out as output.

The control for regulating the main container internal pressure is described in detail in the above Japanese Patent Publication (A) No. 2007-255259, so it will only be summarized.

The control device 27 uses the heated part temperature Th and a steam pressure curve of the working fluid 15 stored in advance in the control device 27 to calculate the saturated steam pressure of the working fluid 15 at the heated part temperature Th.

The target value for the average value of the main container internal pressure (below, referred to as the "main container internal average pressure") is made the average value of the saturated steam pressure of the working fluid 15 at the heated part temperature Th and the atmospheric pressure (0.1 MPa). In the present embodiment, as an approximation of the saturated steam pressure of the working fluid 15 at the temperature of the cooled part 11*b*, the atmospheric pressure (0.1 MPa) is used. Note that it is also possible to make the above average value suitably adjusted in value the target value.

Furthermore, when the auxiliary container internal pressure Pt is lower than the target value, the power actuator 26*b* pushes out the pressure regulating piston 26*a* to reduce the volume of the auxiliary container 21. Due to this, the liquid 23 is compressed and the auxiliary container internal pressure Pt rises.

On the other hand, when the auxiliary container internal pressure Pt is higher than the target value, the pressure regulating piston 26*a* is retracted and the volume of the auxiliary container 21 is reduced. Due to this, the liquid 23 expands and the auxiliary container internal pressure Pt falls.

This being so, the main container internal average pressure changes tracking the auxiliary container internal pressure Pt and as a result approaches the target value. Due to this, even if the heated part temperature Th fluctuates, the main container internal average pressure can be maintained at substantially the target value. For this reason, a suitable main container internal pressure for the heated part temperature Th can be maintained and a drop in performance (output and efficiency) can be prevented.

The characterizing operation in the above configuration will be explained below. The operation of the liquid piston steam engine 10 may be roughly divided into the output mode taking output from the output unit 12, the heat storage mode where heat is stored in the heated part 11*a*, and the start-up mode performed when shifting from the heat storage mode to the output mode. The output mode performs the above basic operation (ordinary operation).

The "heat storage mode" is the mode performed when the heated part temperature Th (° C.) becomes lower in the output mode. In this mode, the control device 27 switches the relay 31 to the rectifier 32 side as shown by the solid line position of FIG. 1 and the DC/DC converter 33 increases the current value.

If the DC/DC converter 33 increases the current value, the generator 12 becomes larger in load, so the speed (displacement speed) of the self-excited vibration of the liquid piston falls and the self-excited vibration of the liquid piston stops.

When the self-excited vibration of the liquid piston stops, the heat exchange amount between the heated part 11*a* and the working fluid 15 remarkably decreases, so the heated part 11*a* stores heat and the heated part temperature Th rises.

The start-up mode is performed in the state where the self-excited vibration of the liquid piston has stopped. In the start-up mode, the control device 27 switches the relay 31 to the sub-controller 35 side as shown by the two-dot chain line position of FIG. 1. Furthermore, the sub-controller 35 drives the generator 12 for exactly a predetermined time (for example, several seconds or so). That is, it is possible to make the generator 12 function as a starter motor and as a result make the liquid piston start self-excited vibration and shift to the output mode.

The output mode, heat storage mode, or start-up mode is switched to by the control device 27. FIG. 2 is a flow chart summarizing the mode switching control processing executed by the control device 27.

Figure 2:
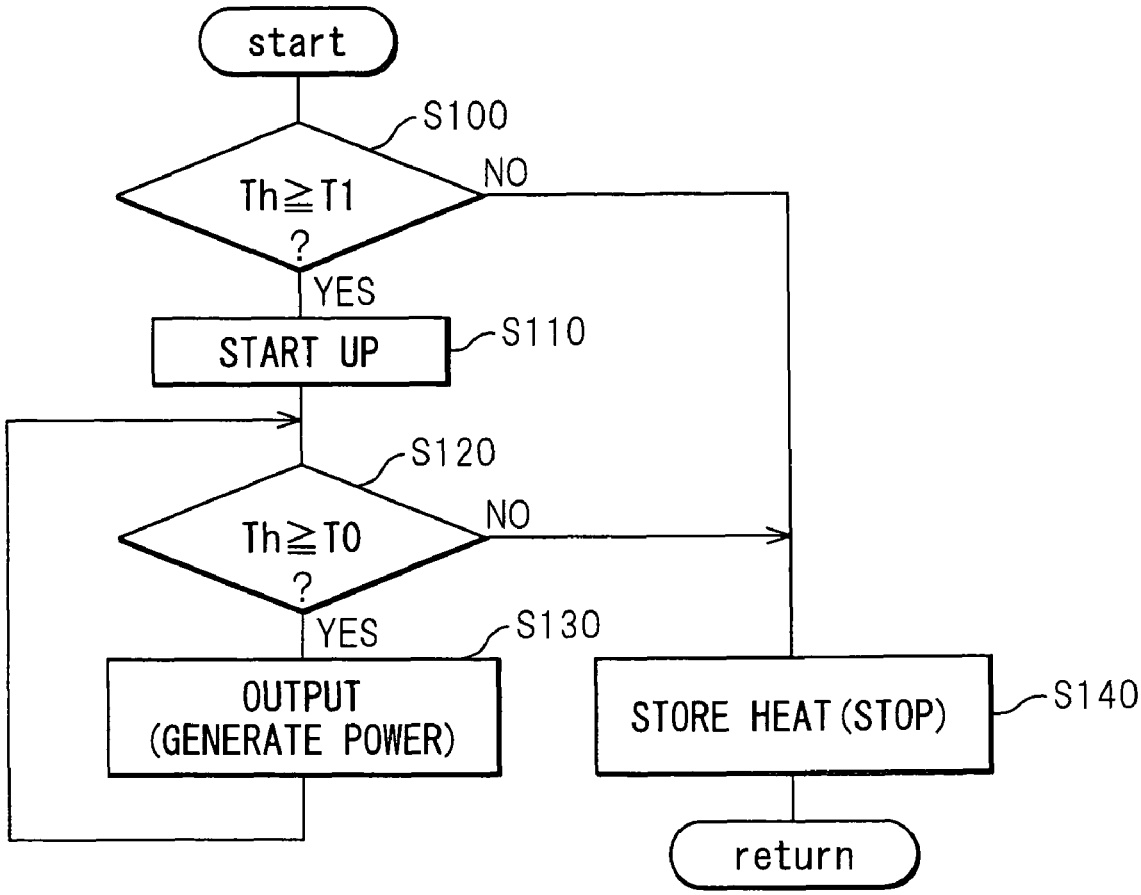
FIG. 2 is a flow chart summarizing mode switching control processing executed by the control device of FIG. 1.

When the self-excited vibration of the liquid piston is detected to stop, the control processing as shown in FIG. 2 is started. First, at step S100, it is judged if the heated part temperature Th is a predetermined temperature T1 or more. The predetermined temperature T1 corresponds to the second predetermined temperature in the aspect of the invention of claim 4 and is a freely determined temperature.

When it is judged at step S100 that the heated part temperature Th is the predetermined temperature T1 or more, the routine proceeds to step S110 where the above-mentioned start-up mode is performed. When at step S110 the start-up mode ends, the routine proceeds to step S120 where it is judged if the heated part temperature Th is at least the predetermined temperature T0.

The predetermined temperature T0 corresponds to the first predetermined temperature in the aspect of the invention of claim 4 and is a freely determined temperature. In the present embodiment, the relationship between the predetermined temperature T0 and the predetermined temperature T1 is T0≦TL.

When it is judged at step S120 that the heated part temperature Th is the predetermined temperature T0 or more, the routine proceeds to step S130 where the above-mentioned output mode is performed to generate power.

When it is judged at step S130 that the heated part temperature Th is less than the predetermined temperature T0, the routine proceeds to step S140 where the above-mentioned heat storage mode is performed to make the self-excited vibration of the liquid piston stop.

When it is judged at step S100 that the heated part temperature Th is less than the predetermined temperature T1, the routine proceeds to step S140 where the heat storage mode is performed to make the self-excited vibration of the liquid piston stop.

As specific examples of the predetermined temperatures T0 and T1, when using water as the working fluid 15 and setting the operating pressure at 1 MPa to 10 MPa, the predetermined temperature T0 is set to 180° C. to 331° C. and the predetermined temperature T1 is set to 180° C. to 331° C. in accordance with the predetermined temperature T0.

Figure 3:
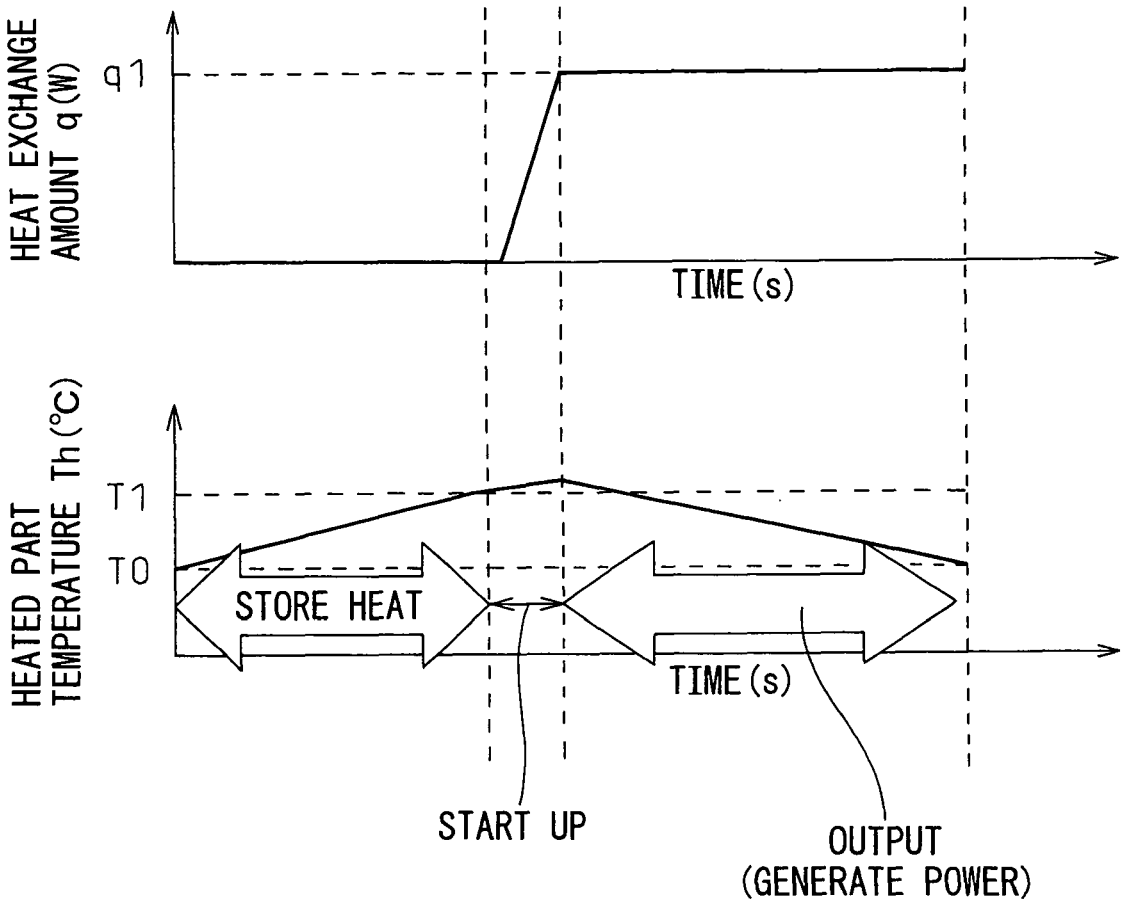
FIG. 3 is a timing chart showing an example of mode switching control in a first embodiment.
Figure 7:
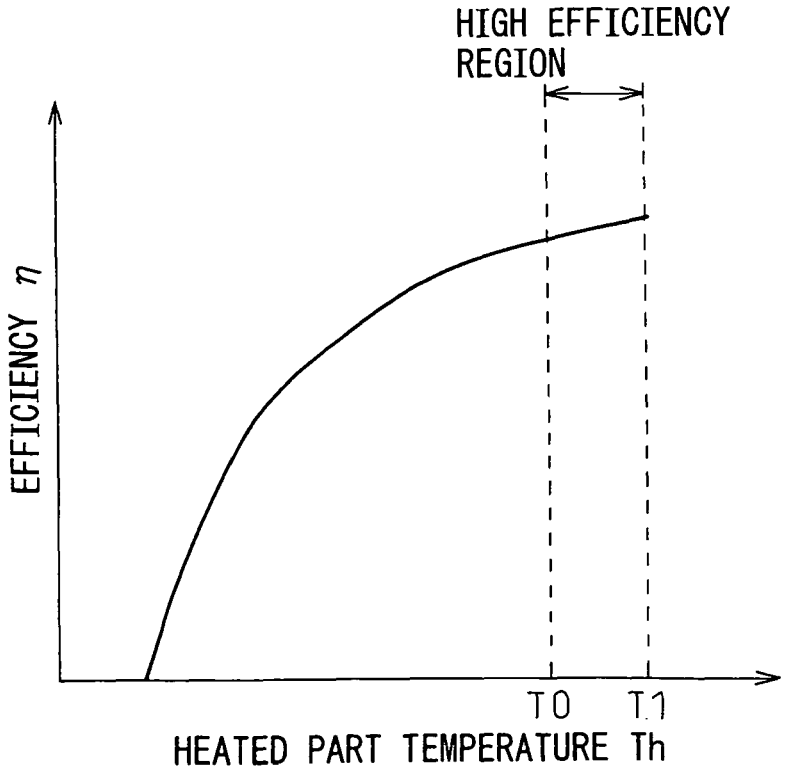
FIG. 7 is a graph showing the relationship between the heated part temperature Th and efficiency $\eta$ of the liquid piston steam engine in the related art.

FIG. 3 is a timing chart showing an example of the mode switching control in the present embodiment. The heated part temperatures T0 and T1 of FIG. 3 correspond to the heated part temperatures T0 and T1 of FIG. 7. FIG. 3 shows an example of the case where the amount of heat given to the heated part 11*a* (below, referred to as "the heated part heat capacity") Q(W) is small.

As shown in FIG. 3, if the heated part temperature Th is less than a predetermined temperature T0, the heat storage mode is performed to make the heated part temperature Th rise to a predetermined temperature T1. In the heat storage mode, the heat exchange amount q between the heated part 11*a* and the working fluid 15 is substantially zero.

If the heated part temperature Th becomes a predetermined temperature T1 or more, the start-up mode is shifted to. In the start-up mode, the heat exchange amount q between the heated part 11*a* and the working fluid 15 gradually increases. At this time, the heated part temperature Th rises somewhat from the predetermined temperature T1.

When the start-up mode ends and the output mode is shifted to, the heated part temperature Th also gradually falls.

Furthermore, if the heated part temperature Th becomes less than the predetermined temperature T0, the heat storage mode is again performed.

In this way, in the present embodiment, the ordinary operation (power generation) is performed intermittently, so even when the heated part heat capacity Q is small, it is possible to raise the heated part temperature Th and increase the heat exchange amount q between the heated part 11*a* and the working fluid 15. For this reason, it is possible to improve the efficiency when the heated part heat capacity Q is small.

As shown in FIG. 3, in output mode, the heated part temperature Th gradually falls because the heated part 11*a* and the working fluid 15 exchange heat and the heat stored in the heated part 11*a* is robbed by the working fluid 15. Furthermore, in the output mode, the heat exchange amount q between the heated part 11*a* and the working fluid 15 is maintained substantially constant to make the auxiliary container internal pressure Pt constant. The main container internal pressure may also be regulated in accordance with fluctuation in the heated part temperature Th. If maintaining the auxiliary container internal pressure Pt constant, the pressure regulator 26 becomes unnecessary.

Second Embodiment

Figure 4:
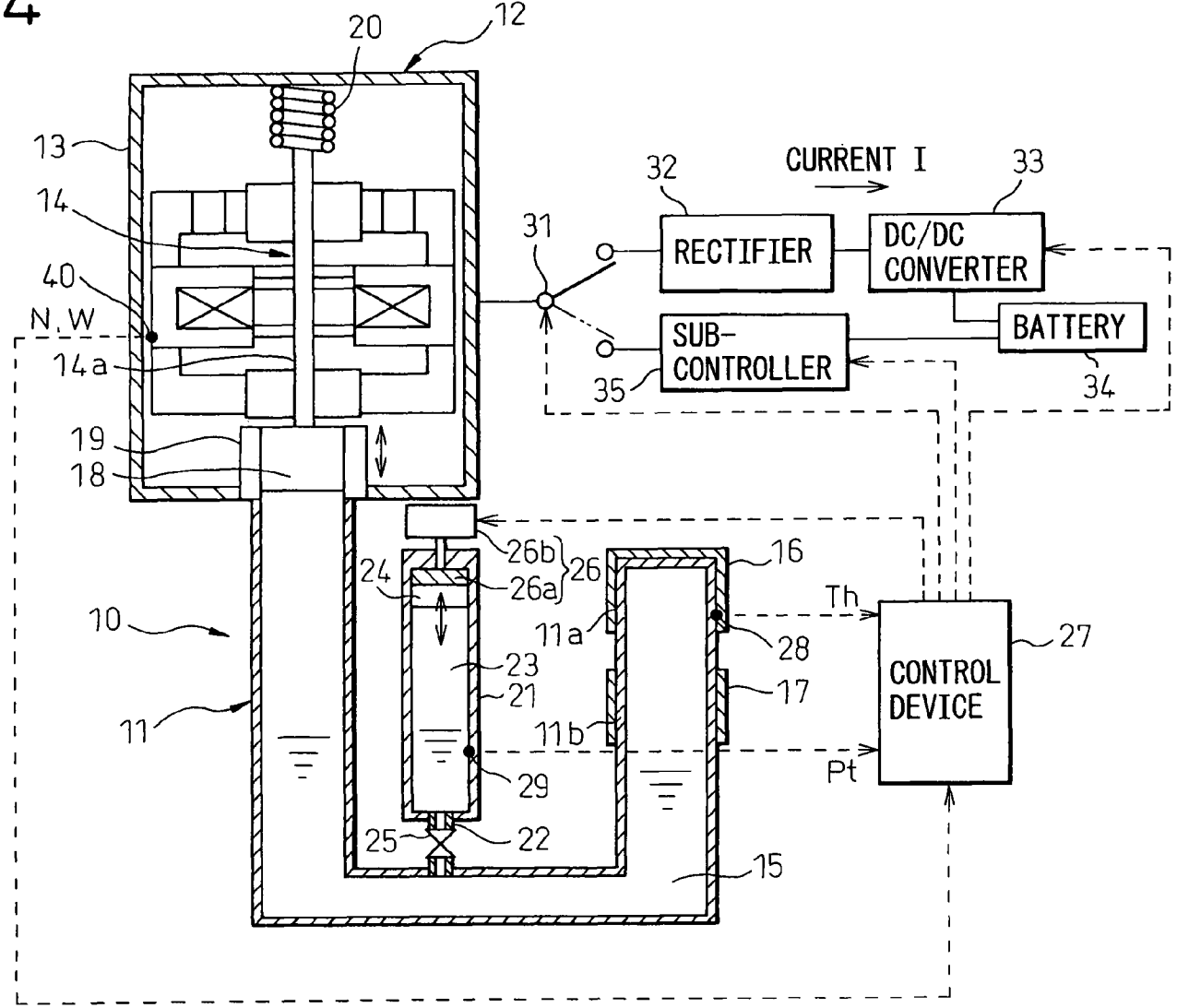
FIG. 4 is a schematic view summarizing the external combustion engine in a second embodiment of the present invention.

In the second embodiment, the time for performing the start-up mode is shortened, compared with the above first embodiment. FIG. 4 is a schematic view of an outline of a liquid piston steam engine 10 in the present embodiment.

The control device 27 receives as input a detection signal from a sensor 40 detecting a frequency N and generated power value W of the generator 12. As the sensor 40, a frequency sensor detecting the frequency N and a power sensor detecting a generated power value W can be used.

As the sensor 40, only a current sensor detecting the current value of the power generated by the generator 12 is used. The control device 27 may use the current value of the power generated by the generator 12 to calculate the generated power value W and frequency N of the generator 12.

Figure 5:
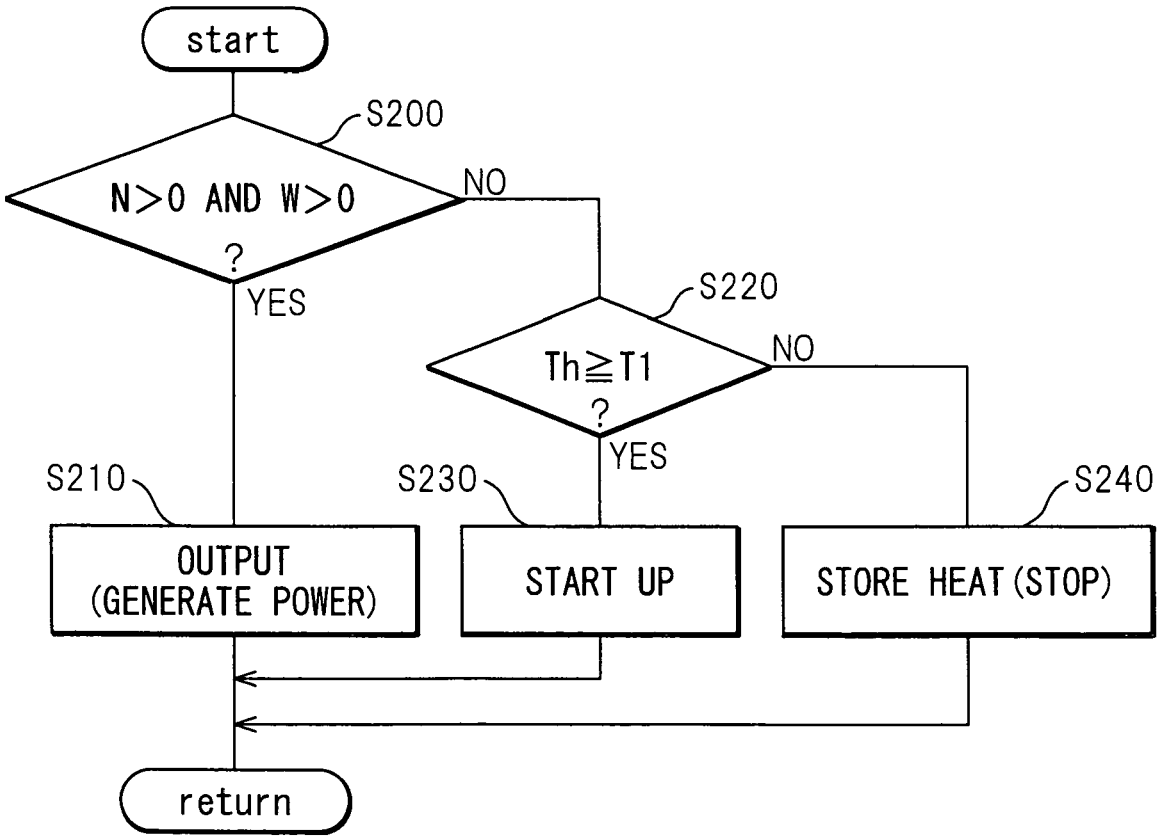
FIG. 5 is a flow chart summarizing mode switching control processing executed by the control device in the second embodiment.

FIG. 5 is a flow chart showing an outline of the control processing performed by the control device 27 in the present embodiment.

First, at step S200, it is judged if the frequency N and generated power value W of the generator 12 are larger than 0.

When it is judged at step S200 that the frequency N and generated power value W of the generator 12 are larger than 0, the routine proceeds to step S210 where the output mode is performed to generate power. When at step S200 the frequency N and generated power value W of the generator 12 are 0 or less, the routine proceeds to step S220 where it is judged if the heated part temperature Th is the predetermined temperature T1 or more.

When it is judged at step S220 that the heated part temperature Th is the predetermined temperature T1 or more, the routine proceeds to step S230 where the start-up mode is performed. When it is judged at step S220 that the heated part temperature Th is less than the predetermined temperature T1, the routine proceeds to step S240 where the heat storage mode is performed and the self-excited vibration of the liquid piston is made to stop.

According to this control processing, at the time of the start-up mode, when the frequency N and generated power value W of the generator 12 exceed 0, the start-up mode is immediately ended and the output mode shifted to. Therefore, compared with when performing the start-up mode for a predetermined time like in the above first embodiment, the time for performing the start-up mode can be shortened.

Third Embodiment

In the above first and second embodiments, by making the self-excited vibration of the liquid piston stop, the heated part temperature Th is made to rise. On the other hand, in the third embodiment, the speed (displacement speed) of the self-excited vibration of the liquid piston is reduced to make the heated part temperature Th rise.

The configuration of the liquid piston steam engine 10 in the present embodiment is the same as that in the above first and second embodiments. Only the control processing executed by the control device 27 differs from the above first and second embodiments.

Figure 6:
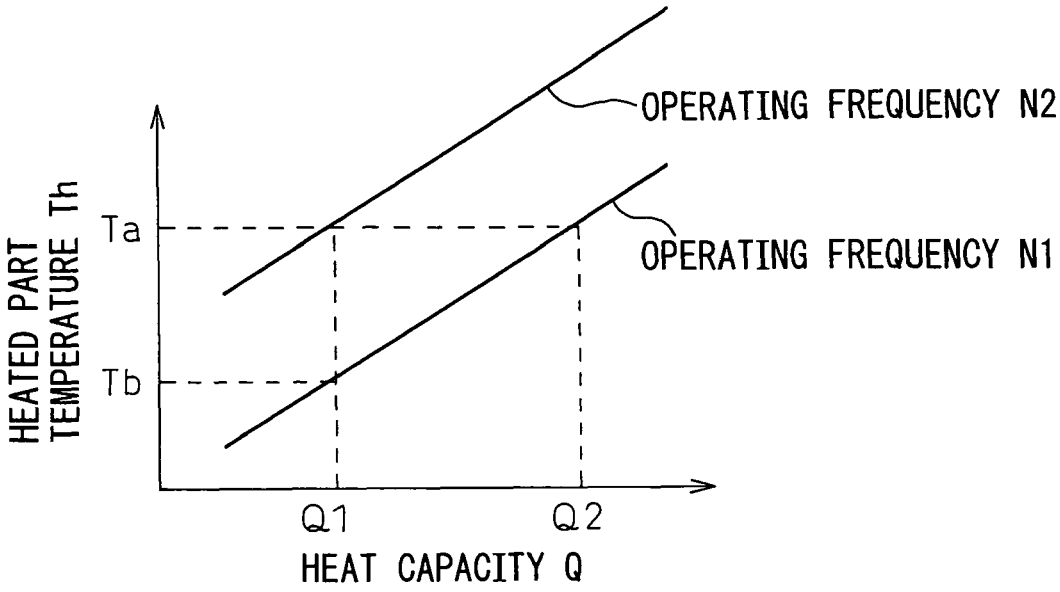
FIG. 6 is a graph showing the relationship between a heated part heat capacity Q and a heated part temperature Th in a third embodiment operated by two different frequencies N1, N2.

FIG. 6 is a graph showing the relationship between the heated part heat capacity Q and the heated part temperature Th in the two different operation frequencies N1 and N2. The "operation frequency" means the frequency of the self-excited vibration of the liquid piston. The faster the displacement speed of the liquid piston becomes, the larger the operation frequency becomes, while the slower the displacement speed of the liquid piston becomes, the smaller the operation frequency becomes.

The relative magnitude of the operation frequencies N1 and N2 in FIG. 6 is N1>N2. As will be understood from FIG. 6, if the heated part heat capacity Q is constant, the smaller the operation frequency becomes, the higher the heated part temperature Th becomes. This is because the smaller the operation frequency, in other words, the slower the displacement speed of the liquid piston becomes, the smaller the heat exchange amount between the heated part 11*a* and the working fluid 15 becomes.

In the present embodiment, when the heated part heat capacity Q is small, the control device 27 performs control processing so that the DC/DC converter 33 increases the current value and increases the load of the generator 12.

Due to this, when the heated part heat capacity Q is small, the operation frequency may be lowered to make the heated part temperature Th a high temperature, so it is possible to improve the efficiency when the heated part heat capacity Q is small. The control device 27 and the DC/DC converter 33 correspond to the displacement speed regulator in the present invention.

Other Embodiments

The above first to third embodiments only show examples of the specific configurations of the controller and displacement speed regulator in the present invention. As the specific configurations of the controller and displacement speed regulator, it is of course possible to use various configurations enabling similar operations as with the above first to third embodiments.

In the above embodiments, the pressure regulator 26 for regulating the auxiliary container internal pressure Pt is comprised of the pressure regulating piston 26*a* and the power actuator 26*b*, but the invention is not limited to this. For example, it is possible to use the various pressure regulator disclosed in the above Japanese Patent Publication (A) No. 2007-255259.

In the above embodiments, the example of application of the present invention to a so-called single cylinder type liquid piston steam engine 10, where the main container 11 as a whole is formed into a single pipe shape, is shown, but the invention is not limited to this. The present invention may also be applied to a liquid piston steam engine, where the part of the main container 11 at the heated part 11*a* side is comprised of a plurality of branch pipes, and the remaining part of the main container 11 is comprised of a single header pipe.

In the above embodiments, the example of application of the present invention to a liquid piston steam engine 10, provided with only one main container 11, was shown. However, the invention is not limited to this. The present invention may also be applied to a liquid piston steam engine, provided with a plurality of main containers 11 and linking the main containers 11 by a single output unit.

In the above embodiments, the case of application of the external combustion engine of the present invention to a drive source of a generating system was explained, but the invention is not limited to this.

The external combustion engine of the present invention may also be utilized as a drive source of other than a generating system.

While the invention has been described by references to specific embodiments chosen for purposes of illustration, it should be apparent that numerous modifications could be made thereto by those skilled in the art without departing from the basic concept and scope of the invention.

The invention claimed is:

1. An external combustion engine comprising:

a pipe-shaped main container in which a working fluid is sealed flowably in a liquid state, a heated part formed at a location of one end of the main container, and heating a part of the working fluid in the main container in order to make it evaporate, a cooled part formed at a location next to the heated part toward the other end of the main container, and cooling the vapor of the working fluid evaporated at the heated part in order to make it condense, an output unit in communication with the other end of the main container, the output unit converting the displacement of the liquid phase part of the working fluid to generate electricity for output, and a controller alternately performing a heat storage mode making displacement of the liquid phase part stop in order to make the heated part store heat and an output mode allowing displacement of the liquid phase part and taking output from the output unit, wherein the controller controls the output unit to stop the displacement of the liquid phase part in the heat storage mode and to use the displacement of the liquid phase part to generate electricity in the output mode, by regulating an external load of the output unit.

2. An external combustion engine as set forth in claim 1, wherein the controller only performs the output mode when the amount of heat given to the heated part is large, and, when the amount of heat given to the heated part is small, the heat storage mode and the output mode are alternately performed.

3. An external combustion engine as set forth in claim 1, wherein the controller decides on the switching between the heat storage mode and the output mode based on the temperature of the heated part.

4. An external combustion engine as set forth in claim 3, wherein the controller performs the heat storage mode when the temperature of the heated part is less than the first predetermined temperature, switches from the heat storage mode to the output mode when the temperature of the heated part becomes a second predetermined temperature or more in the heat storage mode, and switches from the output mode to the heat storage mode when the temperature of the heated part becomes less than the first predetermined temperature in the output mode.

5. An external combustion engine as set forth in claim 4, wherein the second predetermined temperature is the first predetermined temperature or more.

6. An external combustion engine as set forth in claim 4, wherein the controller performs a start-up mode driving the output unit by external power in order to make the displacement of the liquid phase part start, when shifting from the heat storage mode to the output mode.

7. An external combustion engine as set forth in claim 6, wherein the controller performs the start-up mode for a predetermined time.

8. An external combustion engine as set forth in claim 6, wherein the controller determines the end of the start-up mode based on an output power from the output unit and a frequency of the output unit.

9. An external combustion engine comprising:

a pipe-shaped main container in which a working fluid is sealed flowably in a liquid state, a heated part formed at a location of one end of the main container, and heating a part of the working fluid in the main container in order to make it evaporate, a cooled part formed at a location next to the heated part toward the other end of the main container, and cooling the vapor of the working fluid evaporated at the heated part to make it condense, an output unit in communication with the other end of the main container, the output unit converting the displacement of the liquid phase part of the working fluid to generate electricity for output, and a displacement speed regulator for reducing the speed of displacement of the liquid phase part, when the amount of heat given to the heated part is small compared with when the amount of heat given to the heated part is large, wherein the displacement speed regulator increases the external load of the output unit in order to reduce the speed of displacement of the liquid phase part of the working fluid.

10. An external combustion engine as set forth in claim 1 further comprising an auxiliary container communicated with a part of the main container between the cooled part and output unit, and sealed with a liquid, and a pressure regulator for regulating an internal pressure of the auxiliary container based on the temperature of the heated part.

* * * * *